United States Patent [19]

Huntley

[11] 4,121,327

[45] Oct. 24, 1978

[54] CLIP EJECTOR FOR SAFETY SEAT BELT BUCKLE

[75] Inventor: Gerald Huntley, Colorado Springs, Colo.

[73] Assignee: Irvin Industries Inc., Stamford, Conn.

[21] Appl. No.: 820,436

[22] Filed: Aug. 1, 1977

[51] Int. Cl.[2] ..... A44B 11/25

[52] U.S. Cl. ..... 24/230 R; 24/230 A

[58] Field of Search ..... 24/230 R, 230 A, 230 AK, 24/230 AL, 230 AP, 230 AS, 230 AT

[56] References Cited

U.S. PATENT DOCUMENTS

| | | | |
|---|---|---|---|
| 2,629,156 | 2/1953 | Kamens et al. | 24/230 R |
| 3,763,523 | 10/1973 | Lindblad | 24/230 AL |
| 4,000,548 | 4/1977 | Stephenson et al. | 24/230 A |

*Primary Examiner*—Kenneth J. Dorner
*Attorney, Agent, or Firm*—McAulay, Fields, Fisher & Goldstein

[57] ABSTRACT

A clip ejector rides along a track in a belt buckle. The track is molded onto the inner surface of the cover. The ejector is spring biased into a protracted position. A clip when inserted, contacts two shoulders on the ejector, forcing the ejector back until the clip is latched. On unlatching, the spring shoots the ejector forward causing the clip to be positively removed from the buckle. The track constitutes a rail having a longitudinal tubular groove. The ejector has a foot which extends up into the groove through a longitudinal slot in the rail. Two fins extend up from the ejector and ride on either side of the rail.

12 Claims, 9 Drawing Figures

Fig. 4.
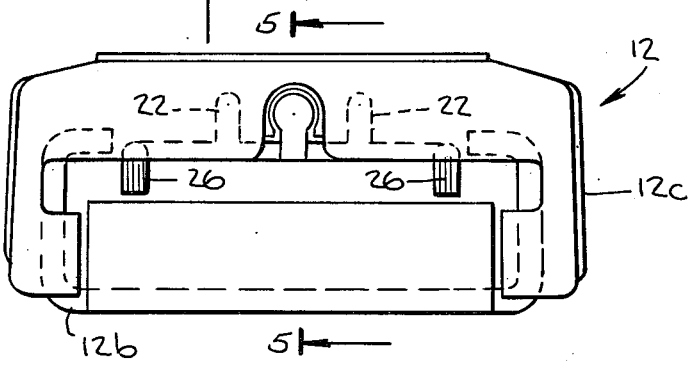
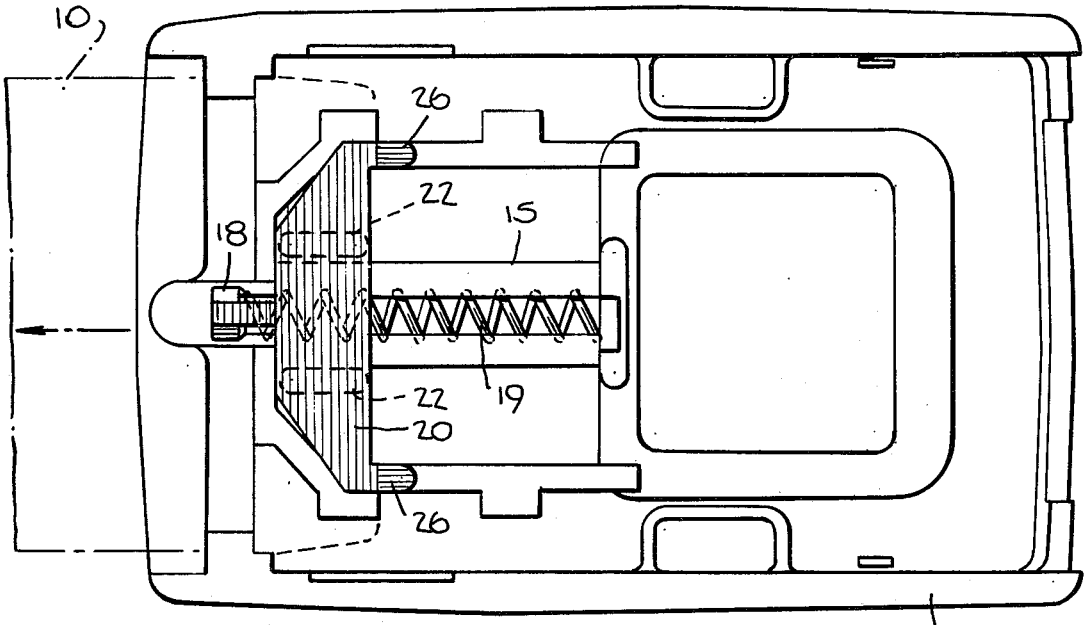
Fig. 6.
Fig. 5.
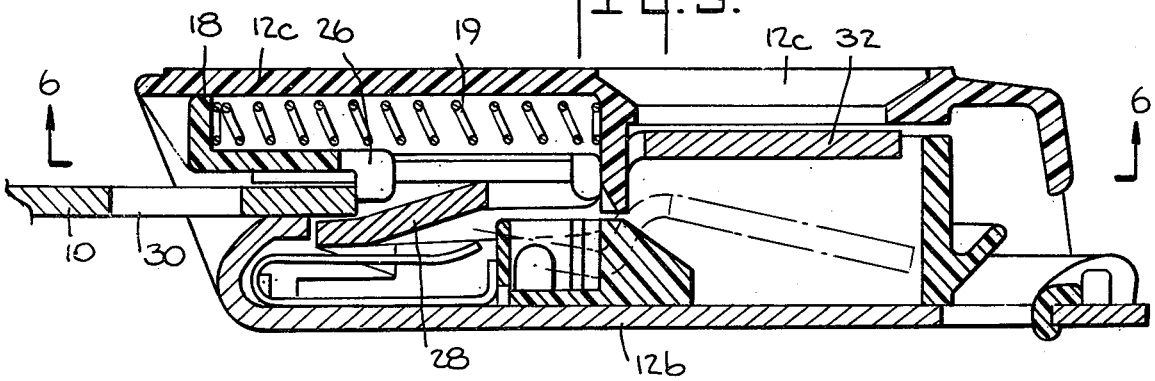

CLIP EJECTOR FOR SAFETY SEAT BELT BUCKLE

BACKGROUND OF THE INVENTION

This invention relates to a mechanism in a safety seat belt buckle to provide a positive and unambiguous ejection of the clip from the buckle once the uncouple release mechanism is actuated.

Most safety seat belt buckles in passenger automobiles provide a finger actuated lever as an uncoupling mechanism. When depressed, the lever removes the latch from the clip opening thereby permitting the clip to be removed from the buckle. Unless the user immediately pulls the clip out or unless there is an eject mechanism that automatically moves the clip away from the latch, the buckle will recouple when pressure on the lever is released.

It is inconvenient to the user to have to remember to pull out the clip and can have an adverse impact on the user's willingness to buckle up. Accordingly, it is one of the purposes of this invention to provide a simple and effective eject mechanism for automatically ejecting the clip from the buckle when the release lever is depressed.

Although eject mechanisms are known and certainly have been suggested, the known eject mechanisms create problems of inconvenience that match or outweigh the convenience provided. For example, it is important that the eject mechanism avoid significantly increasing the resistance to insertion of the clip into the buckle when buckling up. It is also important that the eject mechanism avoid increasing the bulkiness of the buckle.

Accordingly, it is a further purpose of this invention to provide an eject mechanism which provides a net convenience to the user and avoids creating conditions that tend to discourage ready and regular use of a safety seat belt by a driver and passenger.

Because of the enormous volume of seat belts used, any additional feature which adds to the cost of the seat belt will result in a significant total cost. Thus, it is important and it is a purpose of this invention to provide an eject mechanism which is of minimum cost and which can be assembled in the seat belt readily and automatically without requiring additional hand labor.

It is another purpose of this invention to provide an eject mechanism of such a nature that if the ejector fails, the failure will not affect the ability of the user to use and to have an effective seat belt. In general, it is essential that the eject mechanism and the convenience it provides not mitigate against safety.

An eject mechanism may not be used uniformly throughout the industry. Therefore, cost considerations make it important that a standard or uniform part be used on as many seat belt buckles as possible. Accordingly, it is another purpose of this invention to provide an eject mechanism which can be either incorporated in or left out of a standard seat belt buckle design without requiring a change of any part other than the deletion of the critical eject mechanism parts.

BRIEF DESCRIPTION

In brief, the ejection element rides on a longitudinal track along the inner surface of the cover of the seat belt buckle. The cover is molded so as to provide a track along which the spring loaded ejecter element can move. The track is a rail having a groove that runs longitudinally along the inner surface of the cover. Within the groove, a foot of the ejector element rides.

The foot is connected to the main body of the ejector element by a stem which extends down through a longitudinal slot along the rail. Thus, the foot cannot be pulled out of the groove. The arrangement is roughly like that of an over-head rail or mono-rail structure.

In order to simplify assembly, this groove has an open front end at the front edge of the buckle cover so that the foot can be slipped into the groove. Two guide fins form part of the ejector element. The two guide fins extend up on either side of the rail and serve to prevent the ejector element from wobbling relative to the track.

A helical spring is positioned in the tubular groove and biases the foot towards the front opening of the buckle. In this protracted position, the two guide fins abut against a front wall of the cover, under pressure from the helical spring, and prevent the foot from being pushed out the open front end of the groove. The foot and guide fins both extended up from the main body of the ejector element and by engagement with the groove and track permit longitudinal movement of the ejector element within the buckle.

The ejector element has two downwardly extending shoulder portions. The clip abuts against the shoulders when the clip is inserted into the buckle. On insertion of the clip, these shoulders are forced back into the buckle against the pressure of the helical spring until the latch mechanism clicks into place. The latch snaps into the opening of the clip to positively prevent the clip from being removed from the buckle. When the user depresses the release lever, the latch retracts from the clip opening and then, under force of the helical spring, the ejector shoots forward and the two shoulders throw the clip out of the buckle.

In assembly, the helical spring is slipped into the tubular groove through the forward edge opening. The foot of the ejector mechanism is then slipped into the groove while the injector body extends away from the track and away from the cover surface. The spring is compressed until the guide fins clear the front wall of the cover. Then the ejector mechanism is rotated toward the cover surface until it is essentially flush against the cover inside surface. In that position, only the two shoulders extend away from the cover surface. The two guide fins, on either side of the foot, will then bracket either side of the main track, and will keep the ejector from wobbling as well as prevent the spring in the main track from pushing the ejector out the front of the cover.

The belt buckle with this cover can be used without the eject mechanism simply by not assembling the helical spring and the ejector element.

BRIEF DESCRIPTION OF THE FIGURES

In FIGS. 2 and 3, the buckle top is upside down relative to the FIG. 1 deployment in order to illustrate the technique of assembling the ejector into the buckle.

FIG. 4 is an end view looking into the buckle along the plane 4—4 of FIG. 1. FIG. 4 is a view with the clip removed.

FIG. 5 is a cross-sectional view along the plane 5—5 of FIG. 4 except that, in FIG. 5, the clip is shown partially inserted into the buckle opening.

FIG. 6 is a longitudinal sectional view along the plane 6—6 of FIG. 5. In FIG. 6, as in FIG. 5, the clip insertion is only to the point which contacts the clip ejector mechanism and where the spring has not yet been compressed.

DESCRIPTION OF THE PREFERRED EMBODIMENTS

Figure 1:
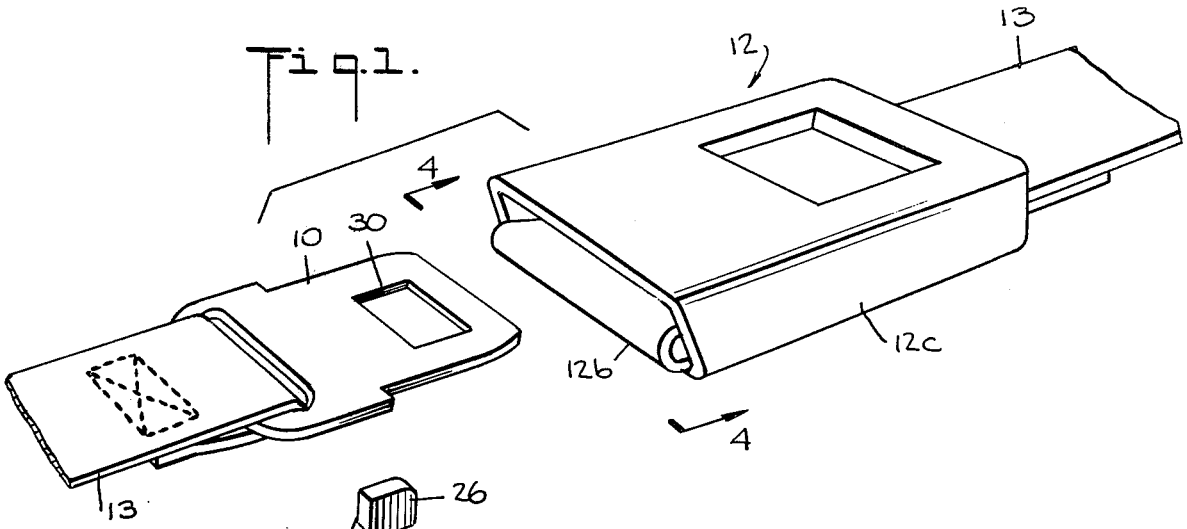
FIG. 1 is a perspective view showing the relationship between a buckle and a clip

FIG. 1 shows a clip 10 and buckle 12 connected to ends of a seat belt strap 13. Clip 10 and buckle 12 are shown in line for engagement. The buckle 12 has a cover 12*c* which snaps over or is fitted onto base 12*b*. The cover 12*c* and base 12*b* define a front opening into which the clip 10 is inserted when buckling up.

The inner surface of the cover 12*c* of the buckle 12 is molded to provide a framework 14 extending downward from the inner surface. A rail 15 portion of the framework 14 provides a longitudinal groove 16 centrally located along the inner surface of the cover. The groove 16 extends back from the open edge of the buckle. A disc like foot 18 of an ejector element 20 rides within this groove 16. A neck 21 connects the foot 18 to the rest of the ejector element 20. The neck 21 extends through a longitudinal slot 17 in the rail 15. The width of the slot 17 is less than the diameter of the foot 18 so that the ejector element 20 is held in place.

Figure 2:
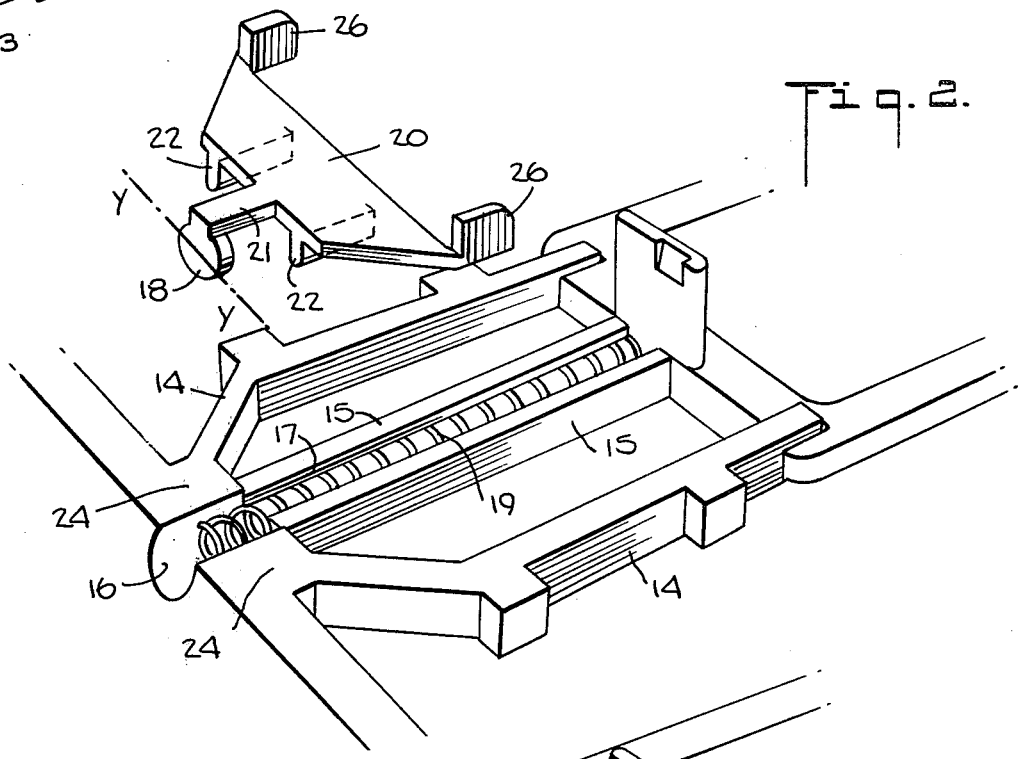
FIG. 2 is a view of the interior of the top of the FIG. 1 buckle showing the relationship between the movable clip ejector element, the coil spring and the stationary portion of the buckle as the clip ejector element is about to be assembled into the buckle.
Figure 3:
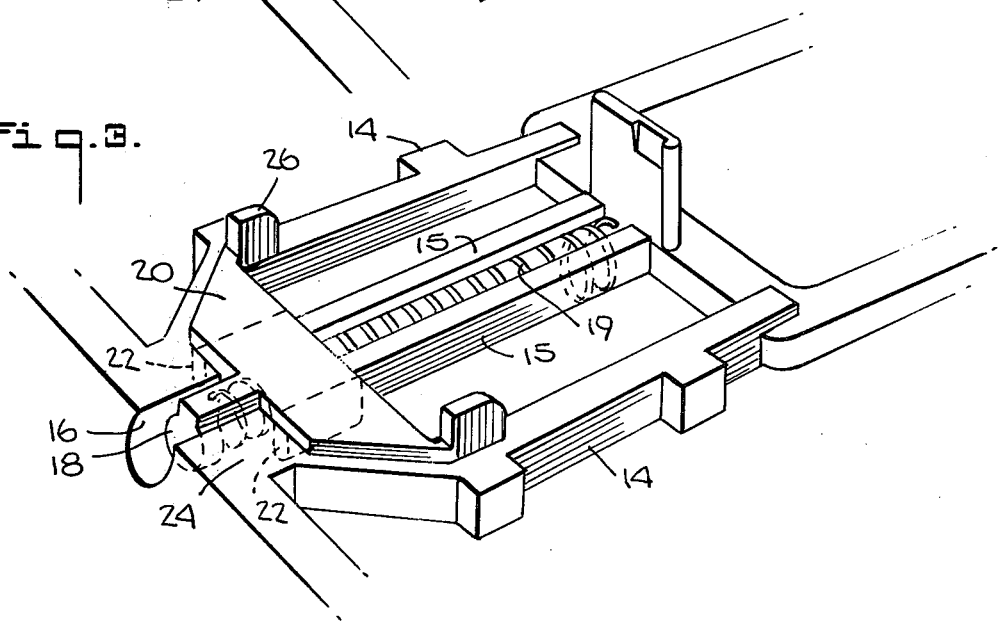
FIG. 3 is a perspective view similar to FIG. 2 showing the clip ejector element fully assembled into the buckle frame.
Figure 7:
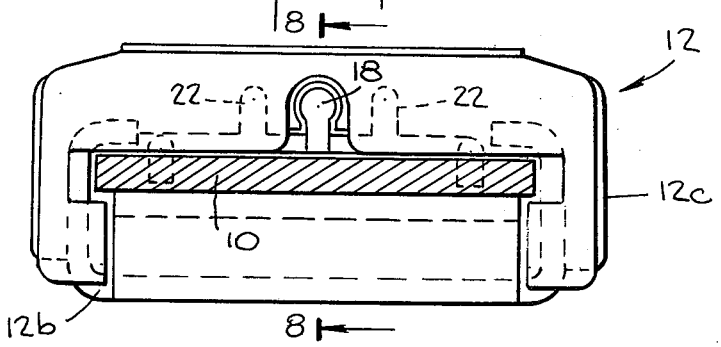
FIG. 7 is a view similar to FIG. 4 showing the clip fully inserted next to the buckle.
Figure 9:
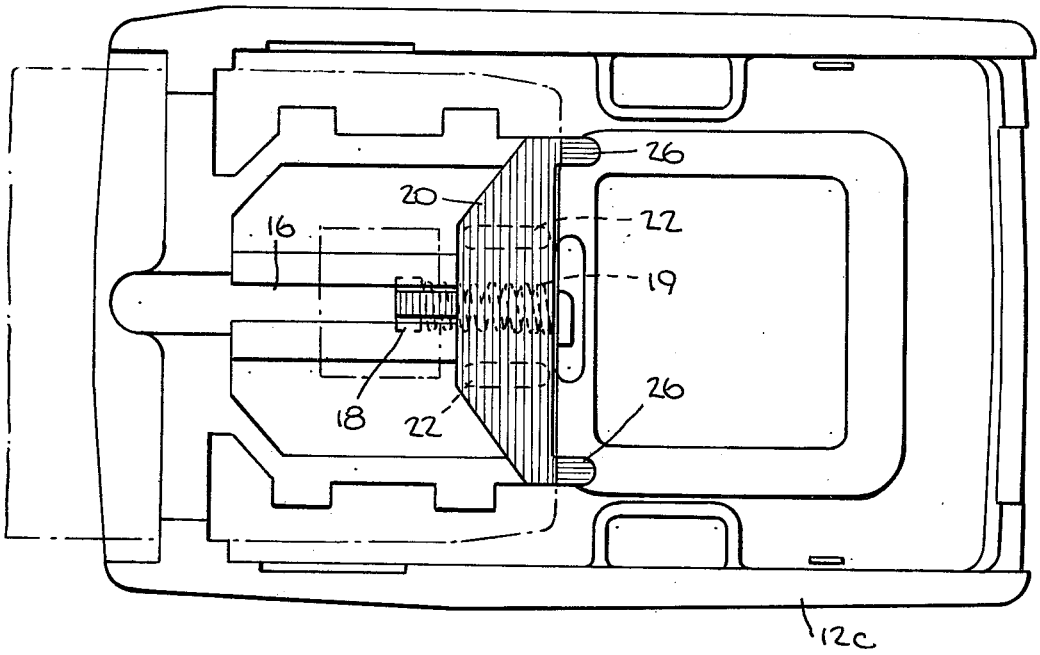
FIG. 9 is a longitudinal section view, similar to FIG. 6 and taken along the plane 9—9 of FIG. 8 illustrating the state where the clip is fully inserted.

A helical or coil spring 19 is in the groove 16 back of the foot 18 to provide a forward bias on the foot 18 and thus on the ejector element 20. In reading this description on the FIGS., it should be kept in mind that FIGS. 2 and 3 are views looking into the inner surface of the top of the buckle cover and these two FIGS. are views upside down relative to the rest of the FIGS.

There is nothing to directly block the foot 18 from being forced out of the front opening of the groove 16. However, two upwardly extending guide members 22 on the ejector element 20 serve the purpose of keeping the ejector 20 in the buckle 12. These guide members 22 abut against a front end wall 24 of the buckle cover and thus prevent the ejector element 20 from being pushed forward out of the buckle housing. The guide members 22 are positioned to contact and ride along the outboard surfaces of the rail 15 that defines the groove 16. By bracketing the rail 15, these guide members 22 prevent racking of the ejector element 20 and maintain its alignment with the rest of the buckle mechanism.

Two downwardly extending shoulders 26 at the outboard ends of the ejector element 20 contact the leading edge of the clip 10 when the clip 10 is inserted into the buckle 12. As the clip 10 is pushed back into the buckle against the shoulders 26, the ejector element 20 is forced back compressing the spring 19 until the latch 28 (see FIG. 5) engages the opening 30 in the clip 10 to hold the clip 10 firmly in position.

Figure 8:
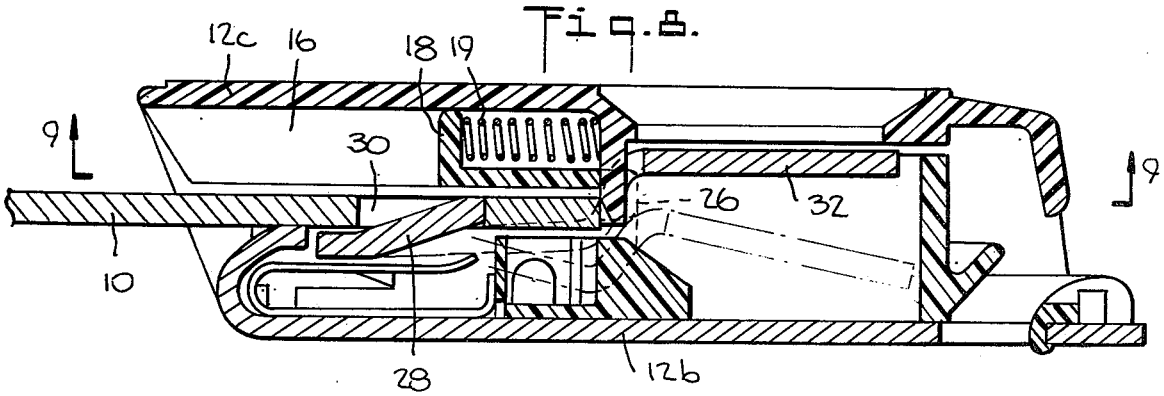
FIG. 8 is a cross-sectional view similar to FIG. 5 but along the plane 8—8 of FIG. 7; again illustrating the clip fully inserted.

In use, when the wearer of the belt wishes to release the clip, the finger actuated lever 32 is pressed down from the latching position shown in FIG. 8 to the dash-dot position as shown therein. In this unlatching position, the latch element 28 is removed from the clip opening 30 and the ejector element 20 springs forward under pressure from the coil spring 19 thereby clearly ejecting the clip 10 from the buckle 12.

One important feature of the arrangement shown is that it provides ease of assembly with a minimum number of parts. Assembly of the ejector 20 into the cover 12c of the buckle 12 only requires that the coil spring 19 be longitudinally inserted into the groove 16 through the open end of the groove 16. The ejector element 20 is then assembled by orienting its position so that the foot 18 can slip into the groove 16. The assemble orientation requires counter-clockwise rotation about the axis Y—Y as shown in FIG. 2. In the assemble orientation, the body of the ejector 20 extends away from the rail 15 and away from the inner surface of the cover 12*c*. The foot 18 is then slipped into the open end of the groove 16 and pushed back against the spring 19 a short distance until the fin-like guide elements 22 clear the front wall 24. The ejector element 20 is then rotated back to the orientation shown in FIG. 3. Subsequent longitudinal movement of the ejector 20 will be limited by contact between the guide fins 22 and the front wall 24. The base 12b is then snapped into the cover 12*c*.

The spring 19 should have sufficient strength so that even when partially compressed it will overcome the friction between the clip 10 and the latch plate and other surfaces on which the clip rides. In this fashion, the ejector overcomes the problem which is known as false latching.

What is claimed is:

1. A belt buckle having an open front edge adapted to receive a clip and having a clip ejector mechanism comprising:

means to retain and release said clip a frame on the buckle;

a rail on said frame, said rail having a longitudinal groove;

a movable ejector element having a foot in said groove, said foot being mounted for movement between a protracted position and a retracted position, said movement being parallel to a predetermined axis;

spring means to bias said foot to said protracted position;

a shoulder portion of said ejector element, said shoulder portion facing the open edge of the buckle when said ejector element is in said protracted position to bear against whatever clip is inserted into said open edge;

said ejector element having a body portion, said shoulder portion and said foot extending in substantially opposite directions away from said body portion along a plane substantially perpendicular to said predetermined axis and a guide member portion of said ejector element, said guide member abutting a wall of said buckle to determine and limit said protracted position.

2. The belt buckle of claim 1, wherein:

said groove has an open end and a longitudinal slot;

said ejector element has a neck portion connecting said foot to said body portion of said ejector element, said neck portion extending through said slot, said foot being free to pass out said open end of said groove except for the restraining effect of said guide member.

3. The belt buckle of claim 2, wherein:

said ejector element is rotatable about a lateral axis substantially orthogonal to said predetermined axis, said ejector element being rotatable between an operative assembled position and a removable position, said guide member clearing said wall of said buckle when said ejector element is rotated to said removable position to permit said foot to pass through said open end of said groove and thereby permit assembling and disassembling said ejector element.

4. The belt buckle of claim 1, wherein:

said guide member has first and second guide elements, said guide elements extending along first and second sides of said rail respectively, said guide member elements and said foot extending in a first direction away from said body portion of said ejector element, said guide member element riding along said respective sides of said rail when said ejector element moves between said retracted and protracted positions, contact between said guide member elements and said sides of said rail during said movement serving to maintain alignment and prevent racking of said ejector element in said belt buckle.

5. The belt buckle of claim 2, wherein:

said guide member has first and second guide elements, said guide elements extending along first and second sides of said rail respectively, said guide member elements and said foot extending in a first direction away from said body portion of said ejector element, said guide member element riding along said respective sides of said rail when said ejector element moves between said retracted and protracted positions, contact between said guide member elements and said sides of said rail during said movement serving to maintain alignment and prevent racking of said ejector element in said belt buckle.

6. The belt buckle of claim 3, wherein:

said guide member has first and second guide elements, said guide elements extending along first and second sides of said rail respectively, said guide member elements and said foot extending in a first direction away from said body portion of said ejector element, said guide member element riding along said respective sides of said rail when said ejector element moves between said retracted and protracted positions, contact between said guide member elements and said sides of said rail during said movement serving to maintain alignment and prevent racking of said ejector element in said belt buckle.

7. The belt buckle of claim 1, wherein:

said spring means is a helical spring within said groove and is positioned back of said foot.

8. The belt buckle of claim 2, wherein:

said spring means is a helical spring within said groove and is positioned back of said foot.

9. The belt buckle of claim 3, wherein:

said spring means is a helical spring within said groove and is positioned back of said foot.

10. The belt buckle of claim 4, wherein:

said spring means is a helical spring within said groove and is positioned back of said foot.

11. The belt buckle of claim 5, wherein:

said spring means is a helical spring within said groove and is positioned back of said foot.

12. The belt buckle of claim 6, wherein:

said spring means is a helical spring within said groove and is positioned back of said foot.

* * * * *